United States Patent [19]

Giflo

[11] 4,299,621

[45] Nov. 10, 1981

[54] HIGH MECHANICAL STRENGTH REINFORCEMENT STEEL

[76] Inventor: Henrik Giflo, III Ujitok u. 5, Miskolc, Hungary

[21] Appl. No.: 54,528

[22] Filed: Jul. 3, 1979

[51] Int. Cl.[3] ..... F16H 29/10

[52] U.S. Cl. ..... 75/124; 75/125

[58] Field of Search ..... 75/124 R, 124 B, 123 B, 75/123 E, 123 N, 123 J, 123 K, 123 L, 125; 52/722

[56] References Cited

U.S. PATENT DOCUMENTS

| | | | |
|---|---|---|---|
| 3,166,406 | 1/1965 | Floreen et al. | 75/124 FE |
| 3,598,574 | 8/1971 | Ito et al. | 75/128 E |
| 3,719,474 | 3/1973 | Bieber et al. | 75/124 C |
| 3,900,347 | 8/1975 | Lorenzetti et al. | 148/12 B |
| 3,989,514 | 11/1976 | Fujioka et al. | 75/124 FB |
| 4,043,807 | 8/1977 | Kirman | 75/124 BC |
| 4,153,454 | 5/1979 | Emi et al. | 75/124 B |
| 4,155,752 | 5/1979 | Oppenheim et al. | 75/124 FB |

FOREIGN PATENT DOCUMENTS

| | | |
|---|---|---|
| 1542343 | 9/1968 | France . |
| 2103905 | 4/1972 | France . |
| 1059615 | 2/1967 | United Kingdom . |
| 1201031 | 8/1970 | United Kingdom . |
| 570657 | 9/1977 | U.S.S.R. . |

*Primary Examiner*—L. Dewayne Rutledge
*Assistant Examiner*—John P. Sheehan
*Attorney, Agent, or Firm*—Beveridge, DeGrandi, Kline & Lunsford

[57] ABSTRACT

A high mechanical strength reinforcement steel able to be welded up to a determined carbon content, and stable to atmospheric corrosion, comprising, besides iron, at most 1.2% (by weight) of carbon, at most 3.5% (by weight) of manganese, at most 2.8% (by weight) of silicon, at most 1% (by weight) of molybdenum, at most 3% of copper and/or nickel, at most 0.15% (by weight) of zirconium and/or cerium and 0.04%–0.3% (by weight) of niobium and/or vanadium, 0.008 to 0.035% (by weight) of nitrogen, 0.0005 to 0.025% (by weight) of calcium, 0.02–0.15% (by weight) of aluminum and 0.001–0.05% (by weight) of boron and/or beryllium.

3 Claims, No Drawings

HIGH MECHANICAL STRENGTH REINFORCEMENT STEEL

This invention relates to a reinforcement or reinforcing rod steel with high mechanical strength, which is easily weldable up to a determined carbon content and resists corrosion by air, which meets in an optimal way the requirements of modern construction. This steel is particularly advantageous in the construction of concrete elements with complex properties, which must exhibit good characteristics of carrying capacity and be able to be used under high temperature conditions and in the preparation of constructions by casing with these concrete elements.

Concrete is one of the most widely used construction materials, which exhibits a high compressive strength, but a low tensile strength. This drawback of concrete has been solved in construction by introducing in the stress zones of the concrete construction elements, steel rods or steel reinforcements that absorb the tensile stresses and relieve the concrete from such stresses. These steel reinforcements are called reinforcement rods. The reinforcement rods can be divided into two groups, depending on the way they are introduced or the stresses to which they are to be subjected. At the same time, the mode of utilization governs the requirements for these steels.

In one mode of utilization, the reinforcement rods are intended to absorb or eliminate, after their introduction, the tensile and shearing stresses to which the construction is subjected. These reinforcement steels are hot-rolled; most often reinforcement rods are involved which are not alloyed or alloyed only slightly and provided with ribs and can be welded or not.

Hot-rolled reinforcement rods should exhibit a guaranteed apparent elastic limit, a suitable flexibility, ribs increasing the adherence necessary for transfer of forces and, if necessary, they should be able to be welded.

In the other mode of utilization, the tensile stresses of the construction are eliminated by reinforcement rods, by a prestress of the concrete elements. This method of utilization makes it possible to reduce considerably the weight of the construction. In this case, the reinforcement steels or reinforcement rods are drawn with a tensile force corresponding to the elastic limit, are prestressed and encased in this state in the concrete.

The concrete element is thereby pre-stressed in compression by the reinforcement steel buried in it after solidification of the concrete; the pre-stress corresponding to the tension used during pre-stressing of the steel. Thus, the tension resulting from the stresses of the construction which are exerted in the concrete element is lowered to a minimal value acceptable for concrete. The pre-stressed reinforcement steel should thereby act as a tension spring, which governs the requirements for such a steel.

The requirements for pre-stressed reinforcement rods are different from the requirements for hot-rolled reinforcement steels because their functions are not the same. Their apparent elastic limit should amount to at least 80% of their tensile strength; and further, the elasticity should exhibit minimal bending, a suitable relaxation and a slight sensitivity to corrosion under stress.

The high tensile strength of reinforcement steels is also an essential industrial requirement. Thus, the greater the tensile strength of the steel, generally the greater its allowed useful stress. Thereby the value of the utilization of pre-stressed reinforcement rods is increased and the loss in tensile force, which is inevitable because of shrinkage and slow deformation of the concrete, thereby loses its importance.

In principle, it would be possible for this reason to use in concrete as the reinforcement rod a type of steel for which the modifications of length resulting from stresses is slight but for which the range of variation of the shape is sufficiently broad.

Buried unpre-stressed reinforcement steel, which is to be used in concrete, should exhibit a plasticity that tolerates a cracking of the concrete as a result of the bending stresses of the construction before breaking of the steel which, however, prevents the reinforcement steel from being subjected to the corrosive action of the environment because of this cracking.

Reinforcement steels suitable for pre-stressing should further exhibit favorable rheological properties and a good stability against corrosion under stress.

There are now known reinforcement steels that can be used under stress or not and exhibiting suitable mechanical strengths. The chemical compositions of reinforcement steels that are not used for pre-stressing are characterized by the fact that the carbon content is most often equal at most to 0.60% by weight and their manganese content is between 0.50 and 1.6% by weight. Some steels in addition contain 0.2–0.6% by weight of silicon and 0.03% by weight of niobium or vanadium. The steels that are used in hot-rolled form and that are not suitable for pre-stressing are generally weldable up to a carbon content equal to at most 0.2%. Their tensile strength is generally between 350 and 600 $N/mm^2$ and they can be used in 40 to 60% of construction. The tensile strength of the unweldable field is between 600 and 800 $N/mm^2$, but only 30 to 40% can be used for transmission of a bending which does not require a definitive modification.

Reinforcement steels used for pre-stressing are made by hot or cold deformation and treatment processes, or by a combination of these treatments, that are costly and complicated. Their chemical composition can be characterized by the fact that their carbon content is generally between 0.50 and 0.80% by weight and their silicon content is between 1.00 and 2.00%, manganese 0.07–1.20% and some other elements and even 0.50–1.50% of chromium and 0.30–0.80% molybdenum. A characteristic of their mechanical properties is a tensile strength between 1300 and 1850 $N/mm^2$ and a tension that requires a deformation of 0.05%, which remains, of 800 to 1200 $N/mm^2$. Slackening of these steels exhibits for a load of 70% of tensile strength a good relaxation.

Reinforcement steels that are known and used exhibit a relatively slight strength. They can be welded only in very narrow strength ranges and are produced by complicated technological processes that require considerable labor to obtain the spring effect necessary for modern use and construction.

The purpose of the invention is the preparation of a reinforcement steel that has a high mechanical strength even in the hot-rolled state and can be welded up to a determined carbon content, which can be used as prestressed reinforcement steel after simple heat treatment for a higher carbon content than was previously possible, which exhibits an excellent relaxation and a stability to corrosion under stress and which is suitable for making concrete elements or casing constructions which meet in an optimal way the requirements of construction but which can also be used at high temperatures.

This purpose is achieved by the fact that the reinforcement steel according to the present invention comprises, in addition to iron and the usual residual elements, at most 1.2% carbon, at most 3.5% by weight of manganese, at most 2.8% by weight of silicon, at most 1% by weight of molybdenum, at most 3% by weight of copper and/or nickel, at most 0.15% by weight of zirconium and/or cerium, 0.04 to 0.3% by weight of niobium and/or vanadium, 0.008 to 0.035% by weight of nitrogen, 0.005 to 0.025% by weight of calcium, 0.02 to 0.15% by weight of aluminum and 0.001 to 0.05% by weight of boron and/or beryllium.

The more particularly preferred steels according to the invention comprise, besides iron and the usual residual elements, the following elements in the proportions indicated below:

| | | | |
|---|---|---|---|
| C | 0.04–1% | Zr | 0.001–0.01% |
| Mn | 1–2.5% | Nb | 0.01–0.2% |
| Cu | 0.05–2% | N | 0.018–0.035% |
| Mo | 0.01–1% | B | 0.001–0.05% |
| Ni | 0.01–1.5% | Ca | 0.0005–0.01% |
| | | Al | 0.02–0,15% |

As may be seen from the foregoing, the steels of the invention, comprise in addition to iron and the usual residual materials, the following components in the indicated weight percent ranges.

| | | | |
|---|---|---|---|
| Carbon | 0.04 to 1.2% | niobium | 0.01 to 0.3% |
| Manganese | 1 to 3.5% | vanadium | 0.01 to 0.3% |
| Silicon | 0,1 to 2,8% | nitrogen | 0.008 to 0.035% |
| molybdenum | 0.01 to 1% | aluminum | 0.02 to 0.15% |
| Copper | 0.05 to 3% | calcium | 0.0005 to 0.025% |
| nickel | 0.01 to 3% | boron | 0.001 to 0.05% |
| zirconium | 0.001 to 0.15% | beryllium | 0.001 to 0.05% |
| cerium | 0.001 to 0.15% | | |

Some of the alloying elements, in the proportions according to the invention, form complex metal compounds which in part, even in the casting stage, form active seed that pre-stress the iron by partly entering into interstitial solution and which in this way multiply the lattice defects.

Other alloying elements form metal precipitates exhibiting a high shearing strength which increases and stabilizes in a coherent manner the internal stress of the base lattice.

Other alloying elements are enriched by occupying lattice defects at the grain boundaries so that the non-coherent precipitation phenomenon is retarded. In this way the enrichment of such precipitates along the grain boundaries is prevented, the homogeneity of their arrangement is assured and the grain boundary strength is increased.

By an increase in the number of crystalline seed of critical dimension, the crystallization capability of the casting is notably raised and solidification time and dimension of the primary grains is reduced. In this way the grain boundary surface in the unit matrix is sharply raised so that the possibility of enrichment formation is notably reduced and the resulting specific stress load is also notably lowered.

The properties of the constituents and their suitable proportions in the alloying system according to the invention create such physical-chemical, kinetic and seeding conditions that, during putting into solution, solidication, recrystallization and hot deformation and the availability of constituents to enter interstitially into solution, the amount of these constituents and the number and degree of stress, of the prestressed lattices in this way are clearly increased. Thanks to the increase of the number of lattices exhibiting an interstitial pre-stress and their degree of stress, there is a notable increase in the number of metallurgically created dislocated dislocations which promote and govern the formation of metal precipitates and the density of their arrangement which results in raising the effectiveness of the precipitation anchoring function during the frontal movement of the dislocation caused by the charges.

Thanks to the elements encased and enriched in the grain boundary defects, the diffusion rate or number of neighboring metal atoms is reduced, thereby the formation of coherent seed is also reduced. Thus, there is avoided the formation along the grain boundaries, of a non-homogeneous zone by alloying elements or precipitations and their mechanical strength or creep strength are reduced. Thereby a bursting is retarded which previously occurred at the grain boundaries as a result of the charges and their elongation and shrinking at breaking by creep are increased.

Because of this phenomenon, the plasticity, capability for hot and cold deformation and useful strength of the reinforcing steel is notably raised.

The elements according to this invention and their proportion make it possible to obtain automatically a remarkable metallurgical quality of the reinforcement steel during its elaboration. In the welding field, the mechanical strength and the endurance limit of the steel is increased several times without cold treatment or deformation but by an effective combination of the consolidation mechanism. In the non-weldable field, it is possible to obtain very simply and with slight costs considerably higher mechanical strength and more favorable rheological properties than for known reinforcement steels.

The reinforcement steel according to the invention also contains in its chemical composition alloying compounds that are concentrated, if necessary, at the surface of the steel during the hot deformation process and which form, with time as a result of atmospheric action on this surface, a protective layer. This layer protects the steel from air corrosion and clearly reduces the rate of corrosion in comparison with known unalloyed reinforcement steels.

The reinforcement steel according to the invention is easily welded up to a determined carbon content and its properties, in the zone affected by heat during welding, are similar to the properties of the starting product.

The reinforcement steel according to the invention can be prepared and worked with the same installations as known reinforcement steels, which means that it does not require new installations and investments to be made in large quantities. It exhibits remarkable mechanical properties and, if necessary, guarantees a stability to air corrosion and broadens the range in which an assembly by welding can be used.

As far as transfer of forces is concerned, it requires a section of reinforced steel that is clearly less and the weight of the concrete construction can thereby be significantly reduced while the prescribed concrete layer is kept.

The costs of making products prepared from the steel according to the invention do not exceed the present average level because of the improved mechanical strength.

The industrial results obtained, thanks to the technical advantages of the reinforcement steel according to the invention such as weight reduction, energy saving and slight maintenance costs, etc, are not burdened by the high costs necessary for making and using the new base material.

The reinforcement steel according to the invention and its mechanical properties are further illustrated by the following examples.

EXAMPLE 1

Three charges of a steel according to the invention were prepared. The charges, referenced as 1 and 2, belonging to the weldable field, were prepared in a 70-ton arc furnace and are then poured in 3.5-ton ingot moulds with a square shape. The resulting cast ingots were then rolled under normal conditions into square blocks having a 180-mm section; they were then rolled into reinforcement rods having grooves and a 16-mm diameter and taken to cool in the air on a cooler.

Charge 3, not belonging to the weldable field, was prepared in a 20-ton arc furnace and poured in a 6-ton ingot mould with a square shape. This charge was then rolled in a way similar to charges 1 and 2 and was prepared in the shape of a coiled, grooved reinforcement rod with an 8-mm diameter and air cooled. The results of tests of the materials are the following:

The charges are prepared by usual metallurgical methods consisting in melting the iron charge in the furnace above indicated, in analysing the composition of the melt and in adding eventually the necessary supplementary ingredients in order to balance the composition. The molten charge is overheated at a temperature superior of about 145° F. to the temperature of the casting and then poured into refining ladles. The different powder additive as indicated in table 1 are respectively added in order to have the final composition as indicated in table 1. The content of the ladles is then poured in shells or in a continuous casting installation as indicated above.

The method and devices used are namely described by L. Bäcker and P. Gosselin in Journal of Metal, May 1971 N°23 p.16 to p.27.

TABLE 1

Chemical composition in percentage by weight:

| | C | Mn | Si | P | S | Cu | Mo | Ni |
|---|---|---|---|---|---|---|---|---|
| 1 | 0.12 | 1.57 | 0.22 | 0.026 | 0.025 | 0.25 | 0.12 | 0.10 |
| 2 | 0.23 | 1.82 | 0.32 | 0.050 | 0.026 | 0.10 | 0.06 | 0.11 |
| 3 | 0.52 | 1.73 | 1.91 | 0.017 | 0.021 | 1.60 | 0.49 | 1.12 |

| | Zr | Nb | V | N | Al | B | Ca |
|---|---|---|---|---|---|---|---|
| 1 | 0.031 | 0.06 | 0.05 | 0.020 | 0.05 | 0.0018 | 0.0030 |
| 2 | 0.027 | 0.07 | 0.04 | 0.018 | 0.04 | 0.0023 | 0.0037 |
| 3 | 0.035 | 0.09 | 0.07 | 0.021 | 0.12 | 0.0027 | 0.0043 |

TABLE 2

Mechanical properties

| Designation | Unit of Measure | Rolled[1] 1 | Rolled[1] 2 | 400° C.[2] 1 | 400° C.[2] 2 | 850° C.[3] 1 | 850° C.[3] 2 |
|---|---|---|---|---|---|---|---|
| $Rp^{0.002}$ | $N/mm^2$ | 570 | 645 | 663 | 712 | 762 | 685 |
| Rm | $N/mm^2$ | 760 | 896 | 780 | 837 | 952 | 914 |
| $A_5$ | % | 21 | 19.2 | 23 | 19.8 | 25.9 | 32.4 |
| Z | % | 57 | 50 | 60 | 58 | 64 | 70 |
| KCU + 20° C. da $J/cm^2$ | | 10–12 | 11.3–12.7 | 12.9–14.6 | 15.7–16.0 | 16–18 | 20–24 |

[1]In rolled state without heat treatment
[2]Kept hot at 400° C. for 30 min and air colled
[3]Kept hot at 850° C. for 45 min and air cooled
In above table
Rp designates elastic limit
Rm designates breaking load
$A_5$ is elongation
Z is reduction of area
KCU is resilience

TABLE 3

The results of tests on reinforcement steel obtained by heat treatment of charge 3 are given below:

| Designation | Unit of Measure | Values |
|---|---|---|
| $R_p^{0.002}$ | $N/mm^2$ | 1720–1956 |
| $R^{proportional}$ | $N/mm^2$ | 1529–1806 |
| $R_m$ | $N/mm^2$ | 1912–2150 |
| $A_{50mm}$ | % | 6.8–7.0 |
| Tensile Reduction of Sample Loaded for More Than 1000 h at 70% of Rm | % | 0.32–1.15 |

I claim:

1. A high mechanical strength reinforcement steel able to be welded up to a determined carbon content, and stable to atmospheric corrosion, consisting essentially of, besides iron and the usual residual elements, 0.04 to 1.2% by weight of carbon, 1 to 3.5% by weight of manganese, 0.1 to 2.8% by weight of silicon, 0.01 to 1% by weight of molybdenum, 0.05 to 3% by weight of copper, 0.01 to 3% by weight of nickel, 0.001 to 0.15% by weight of zirconium or mixture of zirconium and cerium, 0.01 to 0.3% by weight of niobium or mixture of niobium and vanadium, 0.008 to 0.035% by weight of nitrogen, 0.0005 to 0.025% by weight of calcium, 0.02 to 0.15% by weight of aluminum and 0.001 to 0.05% by weight of boron or mixture of boron and beryllium.

2. A high mechanical strength reinforcement steel consisting essentially of, besides iron and the usual residual elements,

| | | | |
|---|---|---|---|
| C | 0.04–1% | Zr | 0.001–0.01% |
| Mn | 1–2.5% | Nb | 0.01–0.2% |
| Cu | 0.05–2% | N | 0.018–0.035% |
| Mo | 0.01–1% | B | 0.001–0.05% |
| Ni | 0.01–1.5% | Ca | 0.0005–0.01% |
| | | Al | 0.02–0,15% |

3. A reinforcing rod having the composition of claim 1.

* * * * *

UNITED STATES PATENT AND TRADEMARK OFFICE

CERTIFICATE OF CORRECTION

PATENT NO. : 4,299,621

DATED : November 10, 1981

INVENTOR(S) : Henrik Giflo

It is certified that error appears in the above—identified patent and that said Letters Patent is hereby corrected as shown below:

In the line designated "[22]" which appears on the front page, the filing date is incorrectly stated as July 3, 1979. The correct filing date is July 2, 1979.

Signed and Sealed this

*Sixteenth* Day of *February 1982*

[SEAL]

*Attest:*

GERALD J. MOSSINGHOFF

*Attesting Officer*

*Commissioner of Patents and Trademarks*